US010801194B2

(12) United States Patent
Meehan et al.

(10) Patent No.: US 10,801,194 B2
(45) Date of Patent: Oct. 13, 2020

(54) RETRACTABLE HOSE WITH DRYING SWEEP AND IN-WALL DRIP TRAY

(71) Applicants: Kathleen Mary Meehan, Bridgeport, CT (US); Clifford William Mollo, Stamford, CT (US)

(72) Inventors: Kathleen Mary Meehan, Bridgeport, CT (US); Clifford William Mollo, Stamford, CT (US)

( * ) Notice: Subject to any disclaimer, the term of this patent is extended or adjusted under 35 U.S.C. 154(b) by 0 days.

(21) Appl. No.: 16/057,775

(22) Filed: Aug. 7, 2018

(65) Prior Publication Data

US 2019/0071851 A1 Mar. 7, 2019

Related U.S. Application Data

(60) Provisional application No. 62/553,674, filed on Sep. 1, 2017.

(51) Int. Cl.
*E03C 1/06* (2006.01)
*E03C 1/04* (2006.01)

(52) U.S. Cl.
CPC ..... *E03C 1/06* (2013.01); *E03C 1/0408* (2013.01); *E03C 2001/0415* (2013.01)

(58) Field of Classification Search
CPC .... E03C 1/0401; E03C 1/0404; E03C 1/0408; E03C 1/06; E03C 2001/0415; E03C 2001/0417; A61H 33/6031; Y10T 137/6943; B08B 9/023
See application file for complete search history.

(56) References Cited

U.S. PATENT DOCUMENTS 2,697,839 A * 12/1954 Jackson ..... E03C 1/06 4/615
2,903,710 A * 9/1959 Pearson ..... E03C 1/06 4/568
2,997,722 A * 8/1961 Dornbierer ..... E03C 1/06 4/570
3,110,038 A * 11/1963 Dornbierer ..... E03C 1/06 4/570
3,806,963 A * 4/1974 Flynn ..... E03C 1/06 4/615
4,360,159 A * 11/1982 Haynes ..... E03C 1/066 239/282
5,093,942 A * 3/1992 Lang ..... A61H 33/6036 239/197
5,493,748 A * 2/1996 Santo ..... A46B 7/023 15/104.04
5,675,847 A 10/1997 Pierre
5,865,378 A * 2/1999 Hollinshead ..... E03C 1/021 239/587.1

(Continued)

*Primary Examiner* — Kevin F Murphy
*Assistant Examiner* — Jonathan J Waddy
(74) *Attorney, Agent, or Firm* — Robert J. Hess; Hess Patent Law Firm

(57) ABSTRACT

A drying sweep/squeegee to remove excess water from a hose in a shower and an in-wall drip pan to catch the excess water so removes as the hose passes through the drying sweep/squeegee. The in-wall drip pan has a bottom incline that is pitched and terminates at an edge, which edge aligns with a slit in a trim plate so that the water flow is down the incline of the in-wall drip pan and into and through the slit in the trim plate. The trim plate has a hollow interior into which is fitted the drying-sweep/squeegee.

12 Claims, 3 Drawing Sheets

(56) References Cited

U.S. PATENT DOCUMENTS

| | | | | |
|---|---|---|---|---|
| 6,000,086 | A * | 12/1999 | Tonks | A46B 7/04 15/104.04 |
| 6,349,428 | B1 | 2/2002 | Nasr et al. | |
| 6,381,770 | B1 | 5/2002 | Raisch | |
| 6,438,767 | B1 * | 8/2002 | Warshawsky | E03C 1/0408 4/567 |
| 6,470,510 | B2 | 10/2002 | Nasr et al. | |
| 6,487,750 | B1 * | 12/2002 | Brown | A62C 33/02 134/122 R |
| 6,920,654 | B2 * | 7/2005 | Noguchi | A47K 3/28 4/601 |
| 7,325,260 | B1 | 2/2008 | Hoyt | |
| 7,707,664 | B1 * | 5/2010 | Flynn | E03C 1/06 4/570 |
| 9,694,370 | B1 * | 7/2017 | Shoemaker | A47K 3/281 |
| 2010/0043135 | A1 * | 2/2010 | Patterson | E03C 1/06 4/612 |
| 2016/0237661 | A1 | 8/2016 | Teagarden | |

* cited by examiner

RETRACTABLE HOSE WITH DRYING SWEEP AND IN-WALL DRIP TRAY

CROSS-REFERENCE TO RELATED APPLICATIONS

This utility patent application is accorded the benefit of priority from U.S. provisional patent application No. 62/553,674 that was filed Sep. 1, 2017.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

The present invention relates to retractable shower hose systems, water seal systems and drip tray systems. More specifically, the present invention relates to a hidden extendable and retractable shower hose system that is adapted to be mounted behind a tub/shower wall and configured to assist in removing moisture from the shower hose as the shower hose retracts and, in the case where the shower hose retracts into the space behind the shower wall, directs water droplets falling off the hose back into the tub/shower via an in-wall drip tray.

Showers equipped with an external and movable showerhead offer the advantage of added flexibility and mobility when compared to a shower with a fixed showerhead. The user can detach the showerhead from a resting position and point the water flow in any direction. However, many such shower systems include an unsightly hose hanging between the showerhead and wall connection point when not in use. This presents both an aesthetic problem and a safety issue. Many shower areas are enclosed with transparent glass panes that leave the inside of a shower visible. A dangling hose can spoil an otherwise minimalist and stylish bathroom design. Additionally, a loose hose can get in the way of a user during the actual showering process. Furthermore, such a hose can increase the risk of injury to those with access to the shower, such as elderly and young children playing in the surrounding area.

In order to address these issues, devices in the prior art disclose shower hoses that are retractable. The problem with such retractable devices is that water that collects on the hose itself during showering is free to drip off the hose in its retracted state to potentially cause water damage from the space into which the hose retracted.

It is desired to provide for a self-draining feature to prevent water that collects onto a retractable shower hose during showering from dripping off within a space into which the hose retracts or to channel or guide such dripping back into the shower itself.

SUMMARY OF THE INVENTION

One aspect of the invention resides in apparatus to remove shower water from an exterior of a shower hose and guide the removed water back into a shower. The apparatus includes s drying sweep/squeegee preferably with flexible finger-like extension that each extend radially toward a common center and a drip pan that has an downwardly inclined or pitched bottom to terminate at a front edge. There is a trim plate with a hollow center that contains the drying sweep/squeegee and that has a slit in its bottom. The front edge of the drip pan is positioned by the base of the trim plate and generally aligns with the slit so that water flowing down its inclined or pitched bottom enters the trim plate to pass into the slit and thereby exit back into the shower.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE PREFERRED EMBODIMENTS

Figure 1A:
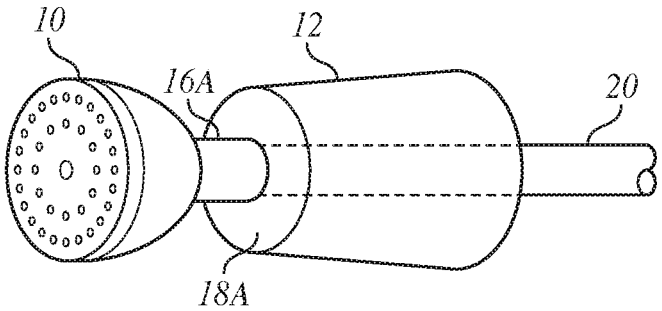
FIG. 1A shows an isometric view of a conventional shower head and a removable bell escutcheon.
Figure 1B:
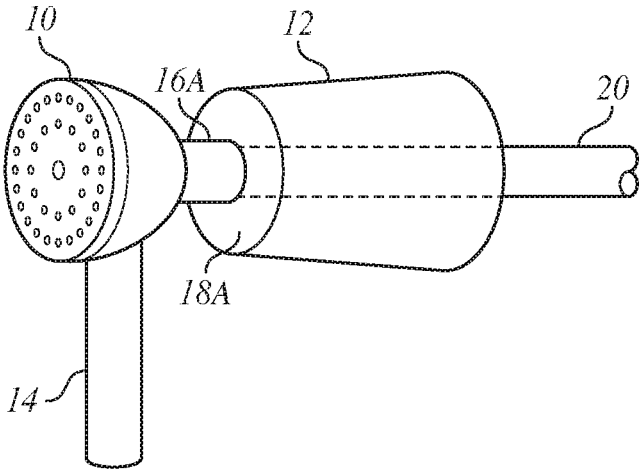
FIG. 1B shows an isometric view of a conventional holder for a hand shower with handle.
Figure 1C:
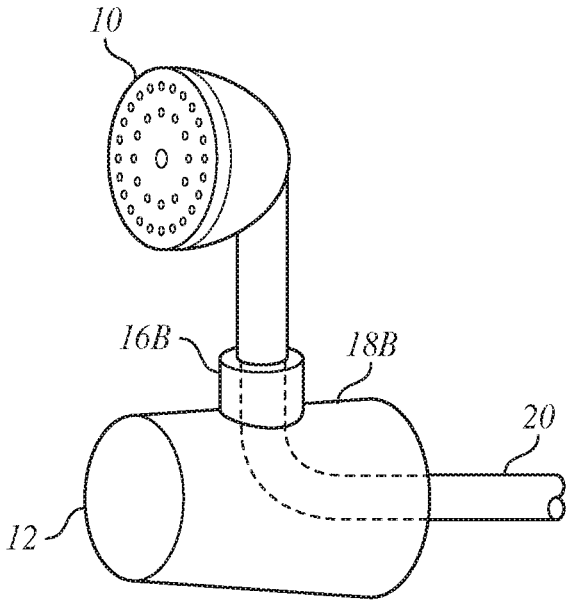
FIG. 1C shows an isometric view of a conventional holder for a shower head.

Turning to FIG. 1A, FIG. 1B and FIG. 1C, three interchangeable conventional shower fixtures are shown for dispensing water via a showerhead 10. FIG. 1A shows a conventional showerhead 10, which is positioned in front of an end of a removable bell escutcheon 12. FIG. 1B shows the showerhead 10 equipped with a depending handle 14 that enables use as a hand shower. FIG. 1C shows a conventional arrangement for positioning a showerhead 10 above the side of the removable bell escutcheon 12. The bell escutcheon 12 has a port 16A at its end face 18A in FIG. 1A and FIG. 1B or a port 16B in a side surface 18B in FIG. 1C.

Figure 2:
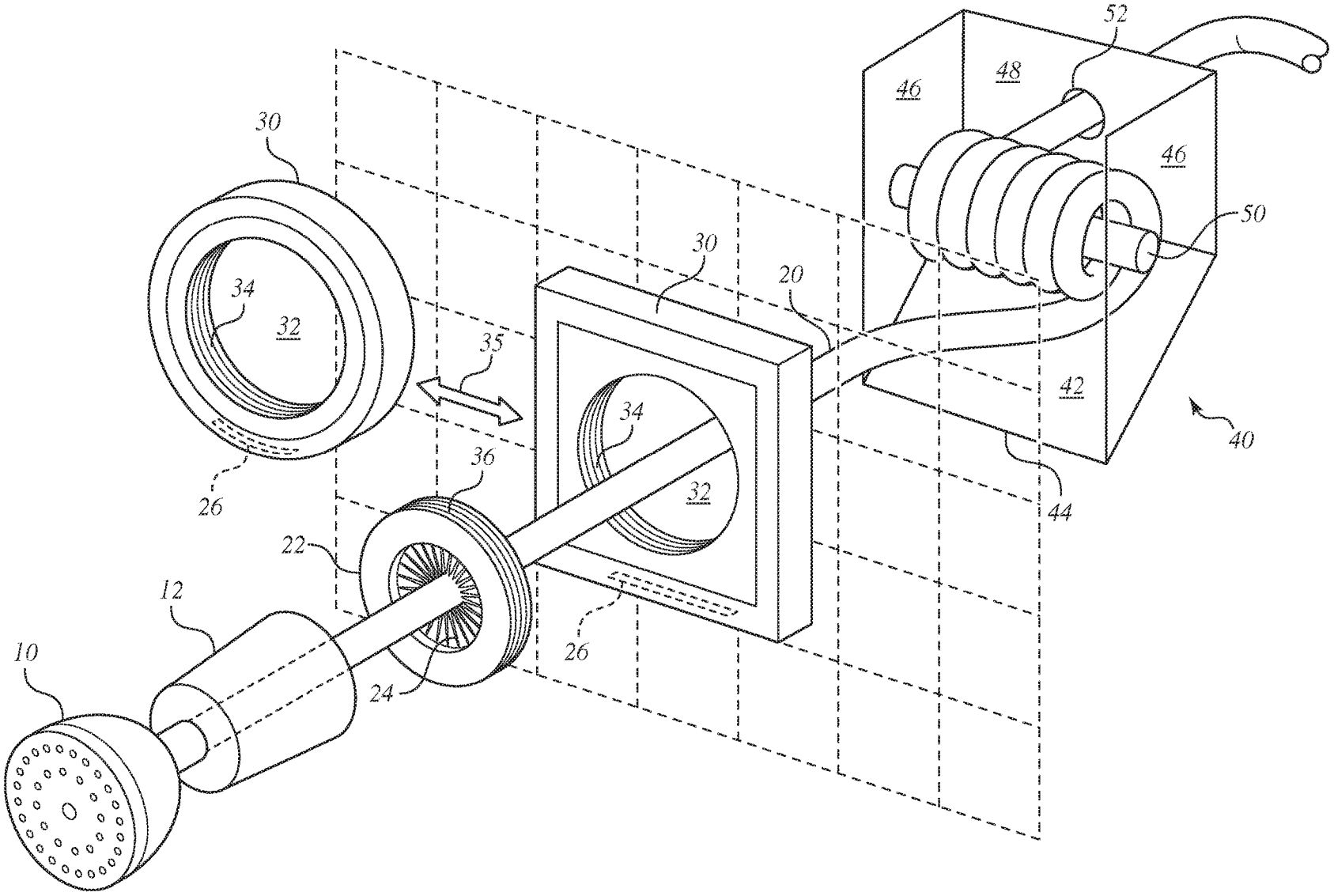
FIG. 2 shows an isometric view of a layout that includes a showerhead and a retractable hose with a drying sweep and an in-wall drip tray in accordance with the invention.
Figure 3:
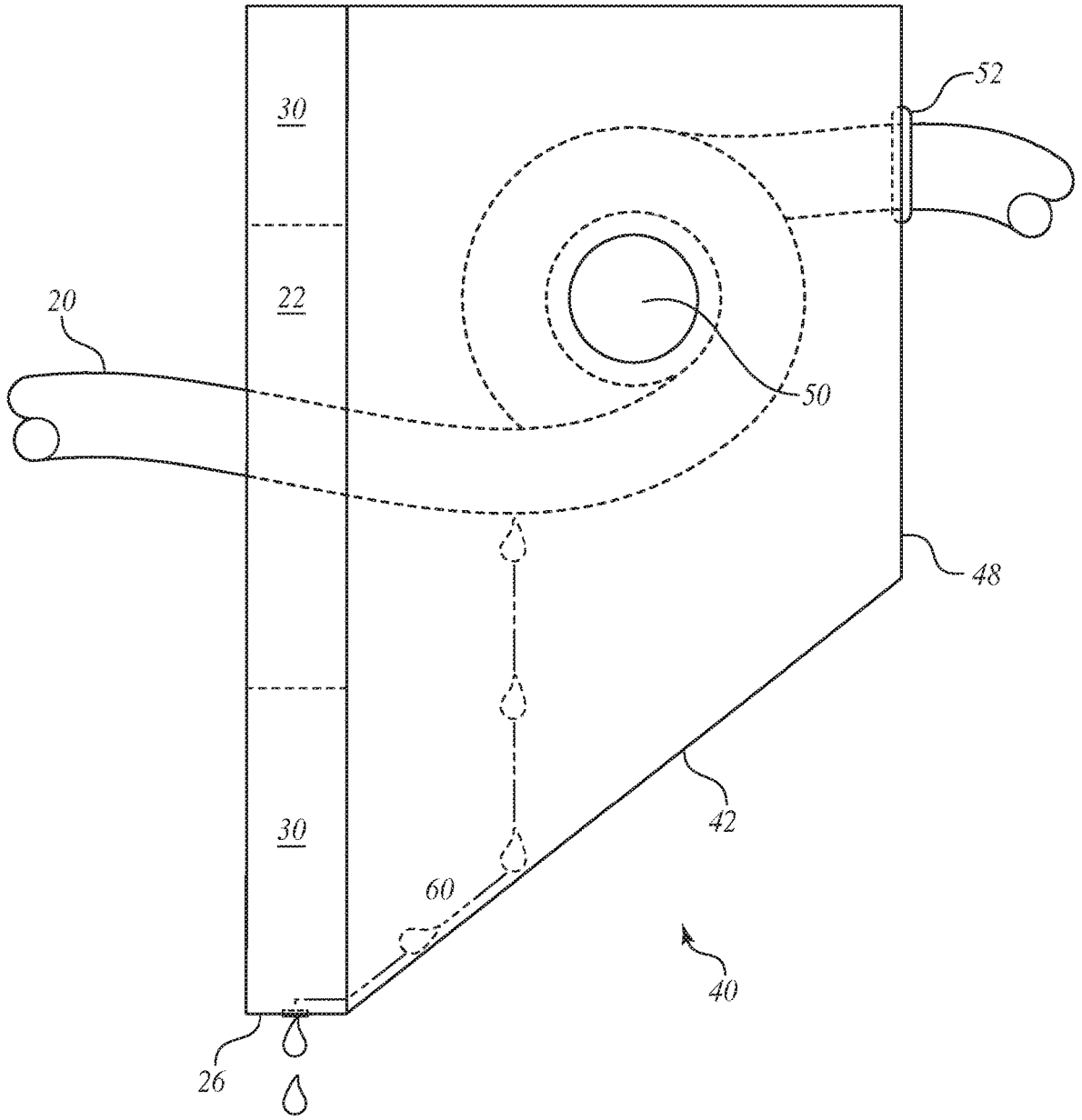
FIG. 3 shows a schematic of an assembly of the layout of FIG. 2 in assembled condition with depiction of a path of travel of shower water wiped off by a drying sweep/squeegee and dripping into a pitched incline to flow through a slit in a trim plate to flow back into a shower.

FIG. 2 shows a layout in accordance with the invention in which a retractable shower hose 20 is arranged to slide past a drying sweep/squeegee or seal 22 as the shower hose 20 retracts, causing any droplets that may have accumulated on the hose 20 to be wiped off by the drying sweep or seal 22 during the retraction. The drying sweep/squeegee or seal 22 may be made of neoprene rubber and may have protecting finger-like extensions 24 that contact the hose 20 as the hose passes so as to block any water droplets on the hose from passing beyond the drying sweep or seal. Alternatively, the drying sweep/squeegee or seal 22 could be in the form of a gasket or ring that is positioned to rub against the hose 20 as the hose 20 retracts past. The drying sweep/squeegee or seal 22 may be held in place by a removable trim plate 30 secured to a shower wall and/or to a drip pan 40.

The drying sweep/squeegee or seal 22 clears excess water off the hose 20 as the hose 20 retracts. The finger-like elongated extensions 24 of the drying sweep/squeegee or seal 22 extend radially toward a common center. These extensions 24 flex in response to the hose 20 passing through back and forth so as to wipe off accumulated water on an exterior of the hose if any. The drying sweep/squeegee or seal 22 wipes the hose off so it's not returning back in the wall wet and gross and scummy until you pull it out again. A wet hose won't 'air dry' in an enclosed space such as behind a wall in a box.

The removable trim plate 30 may have an exterior periphery that is either circular or square. FIG. 2 shows both shapes and a double-headed arrow 35 indicating that both of the shapes are interchangeable with each other. Each of the shapes has a hollow interior 32 bounded by interior directed threads 34, which are positioned to engage with exterior directed threads 36 of the drying sweep/squeegee or seal 22. Whether the removable trim plate 30 is square or circular, it should have an internally threaded circular configuration to accommodate the exterior circular shape of the drying sweep/squeegee or seal 22. The removable trim plate 30 is equipped with a drainage slit 26.

An in-wall drip tray 40 is provided that is pitched at its pitched bottom 42 to drain water 60 off from the hose 20 and into the shower. The pitched bottom 42 has a front edge 44 that is fitted against the bottom rear of the removable trim plate 30 behind the drainage slit 26 of the removable trim plate 30 (whose exterior periphery is shaped as a square) in a leak tight manner. Thus, water 60 flowing down the pitched bottom 42 enters into and passes through the drainage slit 26 of the removable trim plate 30. If the trim plate 30 has an exterior periphery that is circular, then the pitched bottom 42 should have a curved shape to conform to the shape of the trim plate 30 having the exterior periphery that is circular.

As an alternative, the front edge 44 of the in-wall drip tray 40 may be inserted into the rear of the trim plate 30 (over the bottom of the trim plate 30) and preferably adjacent to the rear edge of the drainage slit 26 or spaced back from it. In the latter case, the bottom of the trim plate 30 could also slope down from its rear toward the drainage slit 26. Such an arrangement avoids the need to seal the front edge 44 in a leak tight manner since there would be no back flow of water on the bottom of the trim plate 30, because all the water heads into the drainage slit 26 that flows off the pitched bottom 42 of the in-wall drip tray 40.

The drip pan 40 also has two sidewalls 46 and a rear wall 48 that extends between the two sidewalls 46. A conventional roller 50 is within the in-wall drip tray 40 that is rotatable to selectively retract and discharge the hose 20. The conventional roller 50 may be in the form of a rotatable axial rod that extends between opposite sidewalls 46 and connected thereto in a manner that enables its rotation.

The in-wall drip tray 40 is open at its front and top. The rear wall 48 of the in-wall drip tray 40 may have an aperture 52 for insertion of a supply connection to the retractable hose 20 or permit passage of the retractable hose 20 to connect with a water supply that is beyond the in-wall drip tray 40. The in-wall drip tray 40 is secured in place, for instance, to plywood between studs. The in-wall drip tray 40 is preferably made of a conventional, waterproof material that does not corrode when exposed to water. The in-wall drip tray protects behind the tile wall if the hose or hose connection/supply leaks.

If desired, the trim plate could have alternative geometries, such as oval or any polygon. The pitched bottom of the in-wall drip tray 40 should be shaped to conform to the shape of the trim plate bottom.

While the foregoing description and drawings represent the preferred embodiments of the present invention, it will be understood that various changes and modifications may be made without departing from the scope of the present invention.

What is claimed is:

1. An apparatus to remove shower water from an exterior of a shower hose and to guide the removed shower water into a shower, comprising:

an enclosure that includes an in-wall drip tray, a trim plate, a shower hose retraction assembly and a drying sweep/squeegee made of resilient material, the in-wall drip tray having two sidewalls between which the shower hose retraction assembly extends and having a bottom pitched surface separating the two sidewalls from each other, the trim plate having a hollow interior within which is the drying sweep/squeegee, the trim plate also defining an opening, the trim plate having an internal periphery that defines the hollow interior and is circular in configuration, the drying sweep/squeegee having an external periphery that is circular in configuration, wherein the internal periphery of the trim plate and the external periphery of the drying sweep/squeegee are each threaded to threadably engage each other the shower hose retraction assembly being configured to selectively retract and extend the shower hose through the drying sweep/squeegee via the hollow interior of the trim plate, the bottom pitched surface inclining in a manner so that water dripping onto the bottom pitched surface from above flows down the bottom pitched surface to the trim plate under force of gravity to reach the opening that the trim plate defines.

2. An apparatus to remove shower water from an exterior of a shower hose and to guide the removed shower water into a shower, comprising:

a trim plate whose hollow interior is fitted with a drying sweep/squeegee made of resilient material, the trim plate having a slit that extends from the hollow interior to an exterior of the trim plate, the trim plate having an internal periphery that defines the hollow interior and is circular in configuration, the drying sweep/squeegee having an external periphery that is circular in configuration, wherein the internal periphery of the trim plate and the external periphery of the drying sweep/squeegee are each threaded to threadably engage each other;

an in-wall drip tray having two sidewalls, a rear that extends between the two sidewalls, and a pitched bottom that extends from bases of the two sidewalls and the rear in a pitched, inclined manner to terminate at a free edge, which is positioned relative to the slit in the trim plate so that water flow along the pitched bottom of the in-wall drip tray under force of gravity enters the trim plate in a direction heading toward the slit in the trim plate; and a shower hose wrapping assembly that extends between the two sidewalls and about which the shower hose wraps to enable selective retraction and extension of the shower hose through the hollow interior of the trim plate.

3. The apparatus of claim 2, wherein the assembly includes a roller arranged to retract and dispense the shower hose, the roller including a rod that extends between the two sidewalls of the in-wall drip tray, the roller being rotatable in clockwise and counterclockwise directions.

4. The apparatus of claim 2, wherein the trim plate has an exterior periphery that has a shape of a polygon.

5. The apparatus of claim 2, wherein the trim plate has an exterior periphery that has a circular shape.

6. The apparatus of claim 2, wherein the rear of the in-wall drip tray has an opening.

7. The apparatus of claim 2, wherein the drying sweep/squeegee includes a plurality of elongated extensions that extend radially to flex on an exterior of the shower hose as the shower hose moves past the elongated extensions.

8. The apparatus of claim 2, wherein the shower hose extends from within confines of the in-wall drip tray; further comprising:

a shower head; and a holder that connects with the shower head and the shower hose to permit water flow from the shower hose to the shower head.

9. The apparatus of claim 8, wherein the shower head has a depending handle.

10. The apparatus of claim 8, wherein the holder is hollow and the hose is bent within confines of the holder.

11. The apparatus of claim 8, wherein the holder is hollow and the hose remains straight within confines of the holder.

12. The apparatus of claim 8, wherein the holder is an escutcheon.

* * * * *